United States Patent [19]

Chamdru

[11] Patent Number: 4,480,865

[45] Date of Patent: Nov. 6, 1984

[54] DEVICE FOR GRASPING AND TRANSPORTING OBJECTS AND A METHOD FOR FINISHING SAID OBJECTS WITH THE AID OF SUCH A DEVICE

[75] Inventor: Jacques Chamdru, Le Mesnil Saint Denis, France

[73] Assignee: Regie Nationale des Usines Renault, Boulogne-Billancourt, France

[21] Appl. No.: 359,170

[22] Filed: Mar. 17, 1982

[30] Foreign Application Priority Data

Apr. 7, 1981 [FR] France ..... 81 06983

[51] Int. Cl.[3] ..... B66C 1/46

[52] U.S. Cl. ..... 294/87 R; 294/63 A; 294/93

[58] Field of Search ..... 294/63 A, 67 BA, 86 R, 294/87 R, 90, 93, 99 R; 269/22; 279/2 A; 285/97; 403/5

[56] References Cited

U.S. PATENT DOCUMENTS

| | | | |
|---|---|---|---|
| 3,056,625 | 10/1963 | Timmerman . | |
| 3,161,431 | 12/1964 | Francis | 294/87 R X |
| 3,219,382 | 11/1965 | Hugentobler | 294/93 X |
| 3,347,587 | 10/1967 | Frost | 294/87 R |
| 3,462,934 | 8/1969 | Schulz et al. | 294/93 X |

FOREIGN PATENT DOCUMENTS

| | | |
|---|---|---|
| 326844 | 12/1975 | Austria . |
| 1266931 | 4/1968 | Fed. Rep. of Germany . |
| 1913296 | 9/1970 | Fed. Rep. of Germany . |
| 2028845 | 12/1970 | Fed. Rep. of Germany . |
| 2330460 | 1/1975 | Fed. Rep. of Germany . |
| 2513285 | 10/1976 | Fed. Rep. of Germany . |
| 553283 | 5/1923 | France . |
| 1486737 | 6/1967 | France . |
| 2238662 | 2/1975 | France . |
| 2266581 | 10/1975 | France . |
| 2277025 | 1/1976 | France . |
| 799487 | 8/1958 | United Kingdom . |

*Primary Examiner*—Johnny D. Cherry

*Attorney, Agent, or Firm*—Oblon, Fisher, Spivak, McClelland & Maier

[57] ABSTRACT

A device for grasping and transporting objects exhibiting at least one pair of flexible pads for grasping an object, said pads mounted facing one another on a common support which is movable relative to the object to be grasped. The pads are inflatable toward one another in such a manner as to maintain an interval between themselves in their non-inflated state slightly greater than the distance separating the two opposing faces of the object or of a relief part of the object, and to clamp the faces of the object between themselves when inflated.

4 Claims, 3 Drawing Figures

DEVICE FOR GRASPING AND TRANSPORTING OBJECTS AND A METHOD FOR FINISHING SAID OBJECTS WITH THE AID OF SUCH A DEVICE

BACKGROUND OF THE INVENTION

1. Field of the Invention

The present invention relates to a device for grasping and transporting objects, comprising at least one supple element for grasping an object. This supple element is inflatable with a pressurized fluid and in its inflated state it acts on the object by tightening on it. The object of the invention is also to provide a method for finishing friable objects using the device.

2. Description of the Prior Art

When several sand cores with simple shapes are simultaneously removed from a core case, it is possible to advantageously position the core ejector and to introduce a fork below all the cores making it possible to support and remove the group of cores from the case.

On the other hand when the cores have complicated shapes and/or are oriented at different angles, it is impossible to return the group of cores to the case with a single fork.

The present invention has as its object a device for grasping and transporting objects which makes it possible to simultaneously grasp several objects with the same complicated shape and/or oriented at different angles.

The invention also has as its object a method for finishing friable objects using such a device for grasping and transporting, and which, in particular, makes it possible to trim foundry sand cores to eliminate flash caused by the joint surface of the core case so as to prevent fissuring in objects cast with these cores, such as automobile suspension arms.

The device in conformance with the invention for grasping and transporting objects comprises at least one pair of inflatable, supple pads mounted opposite each other on a common support which is movable relative to the object being grasped. When these pads are moved in the direction of each other in such a manner as to leave between them, in the non-inflated state, a space slightly greater than the distance separating two opposing surfaces of the object or a relief portion of the object, they clamp said surfaces between themselves when inflated.

This device can be adapted without difficulty to grasp objects of any shape by means of an appropriate adaptation of the support which bears the inflatable pads.

In regard to this matter it should be noted that the inflatable pads used in pairs to clamp objects or parts of different objects between them differ both from the point of view of function and structure from known inflatable fingers for grasping objects which are lowered and inflated in a recess in the object. Those inflatable fingers also have the inconvenience of being very fragile.

Each inflatable pad of the device according to the invention is made up of a body revolution made of flexible material, for example rubber or plastic, in the shape of a cup with a cylindrical exterior lateral surface, having an exterior annular rim opposite the base of the cup. This pad is connected to the support by a mounting exhibiting, on the attachment surface with the support, a tip whose exterior shape corresponds to the interior shape of the pad. This tip is encircled at its base by an groove with a depth slightly less than the thickness of said rim of the pad. The mounting includes a pressurized fluid supply opening at the free extremity of the tip, facing the base of the pad attached to said tip.

The pad, is thus simply attached to the tip of the mounting and when the mounting is thus fitted to the support, the rim of the pad is clamped between the mounting and the support. In case of damage to one pad, only the corresponding mounting need be detached to change the pad.

Preferably the support exhibits, at the point of attachment of each pad mounting, a passage orifice whose diameter corresponds to the exterior diameter of the body of the cup-shaped pad and whose depth is equal or slightly greater than the axial distance between the attachment surface of the mounting and the exterior surface of the base of the pad. Thus, when the pad is uninflated, its base does not project beyond the support and does not risk being damaged by the object being grasped when the support together with the pads is placed on the object.

To increase the hold of the pad on the mounting, it is advantageous if the tip of the mounting has a shape of a truncated cone which tapers in the direction of its open end and whose cup-shaped pad body has an interior truncated cone shape flared toward the base.

In order to be able to simultaneously grasp several objects with the aid of the device, the latter comprises several supports capable of being attached in an adjustable manner to a single movable support-bearing plate.

In order to finish friable objects, particularly for fettling foundry sand cores so as to remove flash formed by the joint surface in the core case, one advantageously grasps the cores in the core case at the inside of the exterior contour of the cores and/or above the flash caused by the surface of the joint in the case with the aid of a device comprising as many inflatable padded supports as the case contains cores. Next, the cores suspended from the grasping device are brought above an assembly of thin trimming plates whose interior contour corresponds to the exterior contour of the cores and whose arrangement is identical to that of the cores in the case. The cores are then lowered so that they penetrate into the plates to a depth such that the flash formed by the surface of the joint of the case is removed by the plates.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
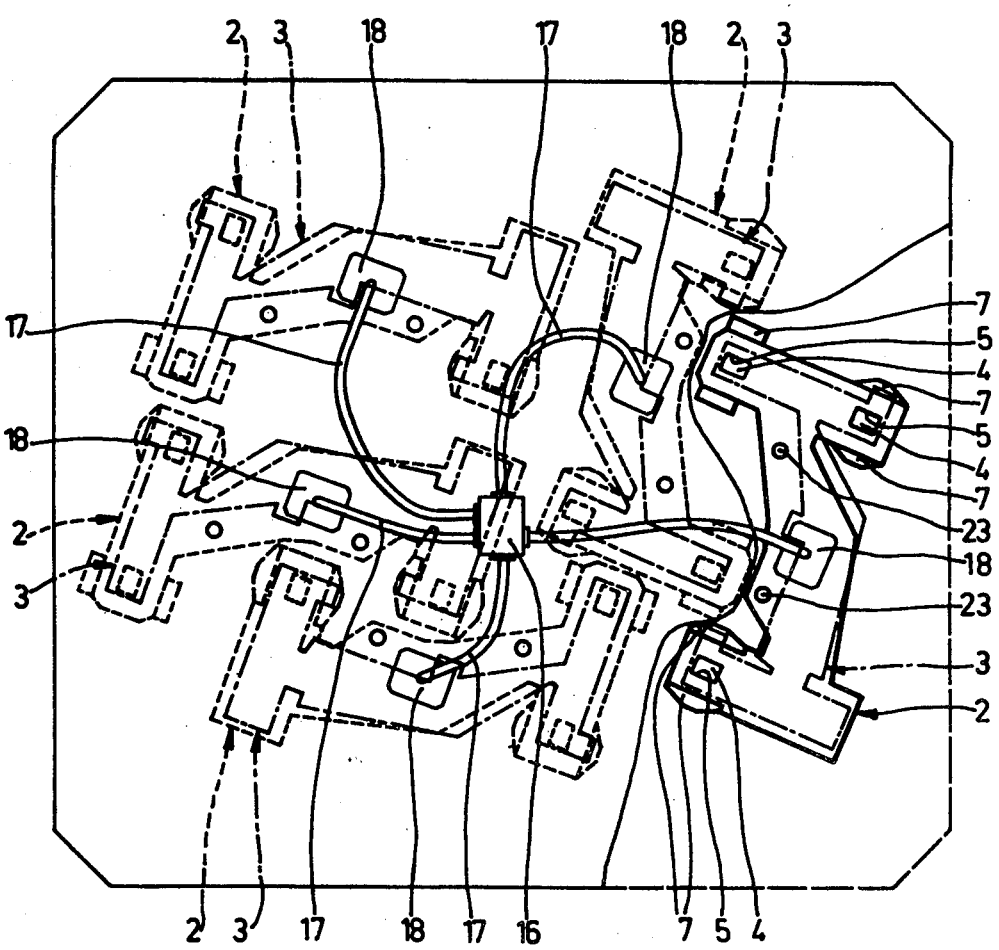
FIG. 1 is a cut away view of a plate supporting numerous padded supports for grasping numerous objects.

According to FIG. 1, a plate 1 is mounted to a handling system, not shown, making it possible to impart to the plate 1 a movement perpendicular to the plane of the drawing, as well as a displacement in the plane of the drawing.

Below the plate 1 are attached in an adjustable manner, for example by screws (not shown), numerous supports 2, each of which is intended to support one object 3, by the means described in detail hereinbelow. It can be seen that the supports 2 have a shape approximating that of the objects 3.

The supports 2 are reciprocally attached to the plate 1 in a disposition chosen in such a manner as to allow the placement of the maximum number of objects 3 of identical shape on a given surface. In the present case, four of the five objects 3, each with a very irregular shape, are oriented at different angles in a plane parallel to the plane of the plate 1.

In the example shown here each object 3 has three parts 4 protruding upward. Each support 2 has three corresponding recesses 5 capable of receiving said protruding parts 4 of the objects 3.

Figure 2:
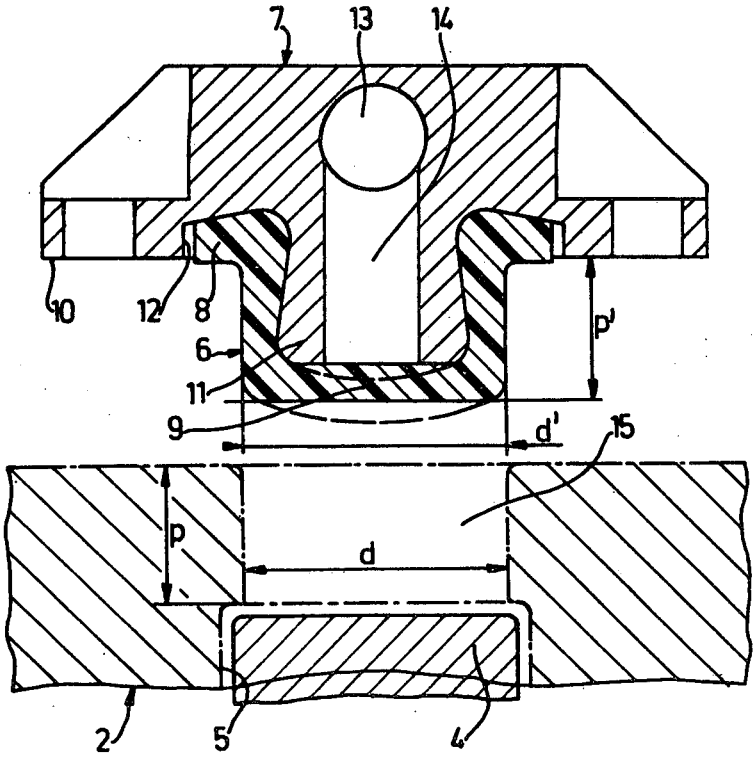
FIG. 2 is a section of an inflatable pad with its mounting.

So that each support 2 can grasp an object 3 on the proper side of the protruding parts 4 of the latter, each support 2 is provided with three pairs of grasping mechanisms shown in detail in FIG. 2.

Each grasping mechanism comprises a supple inflatable pad 6, for example of rubber or a plastic material, and a metal mounting 7 for each pad.

The pad 6 consists of a body of revolution in the shape of a cup whose lateral exterior surface is cylindrical and which has an annular exterior rim 8 opposite the base 9. The lateral interior surface of the cup is a truncated cone which flares in the direction of the base 9.

On its attachment surface 10, the mounting 7 is provided with a protruding tip 11, whose exterior shape corresponds to the interior shape of the pad 6. At its base the tip 11 is inserted within a groove 12 formed in the attachment surface 10. The depth of this groove 12 is slightly smaller than the axial thickness of the rim 8 of the pad 6. The mounting 7 is also provided with a supply channel 13 for pressurized fluid said supply channel being extended by a channel 14 which opens at the free extremity of the tip 11, adjacent the base 9 of the pad 6 joined to the tip 11 of the mounting.

FIG. 2 also shows a support 2, indicated with cross hatching, to which the mounting 7 equipped with its pad 6 can be attached. The support 2 includes for each mounting 7, a passage opening 15 whose diameter d corresponds to the exterior diameter d' of the cup-shaped body of the pad 6. The depth p of the opening 15 corresponds to the axial distance p' between the attachment surface 10 of the mounting 7 and the exterior face of the base 9 of the pad on the tip 11.

Two mountings 7 with pads 6 are attached to projecting parts 4 on two opposing lateral sides of each part of the objects 3, each projecting part fitting in a recess 5, as shown in FIG. 1. The rim 8 of each pad 6 is clamped between the base of the groove 12 in the mounting 7 and the surface of the support 2 to which the mounting 7 is attached.

FIG. 1 also shows that a pneumatic distributor 16 is located above the support bearing plate 1. Said distributor is connected by conduits 17, which traverse the recesses in the plate 1, to the junction blocks 18, each of which is attached to one of the supports 2. Each junction block 18 is connected by the conduits (not shown) to the supply channel 13 of each of the mountings 7 attached to each support 2.

To grasp the objects 3 with the device in FIG. 1, it is sufficient to lower the plate 1 with the supports 2 onto the objects 3, the pads being deflated by opening the distributor 16 to ambient air, in such a manner that the protruding parts 4 of the objects 3 penetrate into the recesses 5 of the supports 2 until the supports 2 come in supporting contact with the objects 3. By sending compressed air to various pads 6 with the help of the distributor 16, the pads 6 are inflated. When the rim 8 of each pad 6 is clamped between the mounting 7 and the support 2, and when, in addition, the pad 6 has penetrated to its total height into the opening 15 in the support 2, the inflation of the pad 6 is confined to the base 9 of the latter, which swells out in the manner indicated with a broken line in FIG. 2. Each protruding parts 4 of each object 3 is thus clamped between the bulging bases 9 of two opposing pads 6.

One particularly interesting use for the grasping and transporting device described above is for extracting sand foundry cores from a core case, particularly when the various cores have complicated and/or different shapes and/or are oriented at different angles in the case. When these cores are intended for use in casting objects which must not be subject to fissuring, such as safety objects for automobiles, for example suspension arms, it is necessary to remove from the foundry cores the flash that forms at the points where case surfaces form a joint, because this flash leads to the formation of these fissures.

Figure 3:
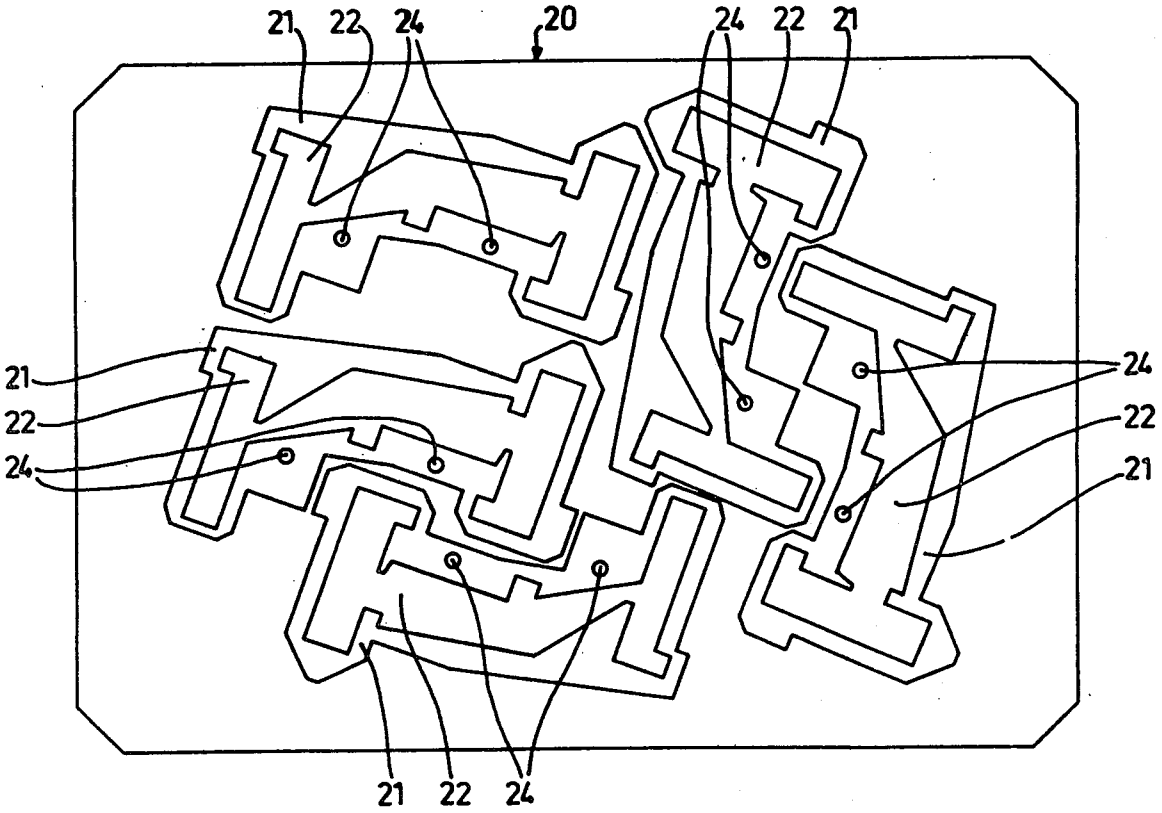
FIG. 3 is a cut away view of an assembly of numerous trimming plates for finishing the sand cores grasped by the device in FIG. 1.

In order to remove the flash from such foundry sand cores, but also to generally finish other friable objects, it is advantageous to grasp the cores in the core case with the aid of the grasping and transport device as described above and shown in FIG. 1, and with the cores suspended from this device, to bring them over an assembly of trimming plates illustrated by FIG. 3.

The trimming assembly consists of a support plate 20 onto which are attached in an adjustable manner, by means that are not shown, for example by screws, as many trimming plates 21 as the plate 1 of the grasping and transport device has supports for the cores 3. In each plate 21 a cut-out 22 is made whose shape corresponds to the exterior shape of a core 3. The positions of the various plates 21 correspond to the positions of the cores 3 below the plate 1 which, in turn, correspond to the positions of the cores 3 in the core case.

After having placed the cores 3 suspended by the supports 2 above the plate 1 below the trimming plates 21, one lowers the cores so that they penetrate into the plates 21. The depth of penetration of the cores 3 into the plates 21 is such that the flash formed on the cores 3 by the joint of the core case is removed by the plates 21.

To assure secure grasping of the cores 3 in the case by the supports 2, these latter are advantageously mounted ajustably on the plate 1. The free supports 2 having been placed on the cores in the case, one lowers the plate 1 onto the case. The plate engages the case index pins and can then be lowered onto the supports 2 which are then attached in their correct position to the plate 1.

Advantageously, each support 2 comprises several removable centering pins 23 shown in FIG. 1. The trimming plates 21, according to FIG. 3, have several centering holes 24 on their sides. These make it possible to center the plates 21 in reference to the supports 2 when the cores 3 are first lowered onto the trimming assembly. This is facilitated by the centering pins 23 of the support 2 before the plates 21 are attached to the plate 20. Then the pins 23 are retracted.

Of course the attached drawing is only provided as a non-limiting illustrative example. The device for grasping and transporting may thus be used for objects of any shape. When the objects do not have projections, it is possible to grasp them by their edge, between two opposing points in each case.

The number of pairs of inflatable pads used to grasp an object is also variable and depends, among other things, on the shape, the size and the fragility of the objects.

It is advantageous to select the position of the mountings 7 on the supports 2 in such a manner that they can be removed to replace the pads 6, and then reattached without having to remove the supports 2 of the plate 1.

What is claimed as new and desired to be secured by Letters Patent of the United States is:

1. A device for transporting and grasping objects, said device comprising:

a support movable relative to said object;

a pair of mountings oppositely mounted on said support for movement towards and away from one another and said object within said support, each of said mountings including an attachment face facing said support, a tip extending from said attachment face, a groove on said attachment face and surrounding said tip, and a pressurized fluid conduit opening on the distal end of said tip; and a cup shaped supple element mounted on each said mounting, each said supple element being in the form of a body of revolution having a base adjacent said distal end of said tip, a cylindrical lateral surface, and interior surface conforming to said tip, and a rim in said groove, the height of said rim being greater than the depth of said groove, whereby movement of said mountings of said pair of mountings towards one another clamps said rim between said attachment face and said support and whereby pressurized fluid from said conduit extends said bases of opposing supple elements towards one another to grasp said object therebetween.

2. The device of claim 1 including:

a recess in said support for a portion of said object to be grasped; and a passage orifice in said support for each said mounting, each said orifice extending between said recess and said mounting, having a depth corresponding to the height of said tip and supple element and having a diameter corresponding to that of said supple element, whereby each said mounting can enter one said orifice for grasping said object.

3. The device of claim 1 or 2 wherein said tip and the corresponding interior of said cup define a truncated cone tapering inwardly towards said attachment face.

4. The device of claims 1 or 2 including:

a plurality of said supports;

means for centering said supports relative to said objects to be grasped;

a movable plate; and means for adjustably attaching said supports to said plate;

whereby a plurality of said objects can be simultaneously grasped.

* * * * *